United States Patent [19]

Dreulle

[11] 4,238,532

[45] Dec. 9, 1980

[54] ZINC ALLOY AND GALVANIZATION PROCESS

[76] Inventor: Noël Dreulle, 5 Rue Fourques, Douai, France

[21] Appl. No.: 28,919

[22] Filed: Apr. 10, 1979

Related U.S. Application Data

[62] Division of Ser. No. 834,975, Sep. 20, 1977, Pat. No. 4,168,972.

[30] Foreign Application Priority Data

Oct. 1, 1976 [FR] France ..... 76 29545

[51] Int. Cl.[3] ..... C23C 1/02

[52] U.S. Cl. ..... 427/309; 427/310; 427/433

[58] Field of Search ..... 427/309, 310, 433; 428/659; 75/178 AN, 178 T

[56] References Cited

U.S. PATENT DOCUMENTS

| | | | |
|---|---|---|---|
| 3,320,040 | 5/1967 | Roe et al. | 75/178 R |
| 4,152,472 | 5/1979 | Ohby et al. | 427/433 |

*Primary Examiner*—Ralph S. Kendall

*Attorney, Agent, or Firm*—Young & Thompson

[57] ABSTRACT

An alloy suitable for the galvanization of steels by an immersion galvanization process, including gavanization of steels containing silicon, which alloy comprises zinc of commercial purity and has a lead content of the order of 1000 to 20000 p.p.m. by weight, an aluminium content of from 100 to 5000 p.p.m. by weight, a magnesium content of from 10 to 1000 p.p.m. by weight and a tin content of from 300 to 20000 p.p.m. by weight.

A galvanization process using the said alloy is also described.

3 Claims, 3 Drawing Figures

ZINC ALLOY AND GALVANIZATION PROCESS

This is a division of application Ser. No. 834,975, filed Sept. 20, 1977, U.S. Pat. No. 4,168,972.

BACKGROUND OF THE INVENTION

The inventior relates to an alloy intended for the immersion galvanisation of steels and also to an immersion galvanisation process utilising this alloy.

DESCRIPTION OF PRIOR ART

Immersion galvanisation is conventionally effected in a bath of molten zinc containing about 0.1 to 1.5% of lead. The zinc used is generally a zinc of commercial purity corresponding to the standards AFNOR NFA 55101 of April 1955, classes Z6 or Z7. For example, a Z7 zinc contains 0.15% of Cd, 0.02% of Fe, and 0.002% of Cu as tolerated impurities. The actual galvanisation is generally preceded by operations of degreasing, pickling by immersion in hydrochloric acid containing a corrosion inhibitor, and fluxing or deposition of a coating of flux of the zinc chloride or ammonium type. The coating of zinc is considered satisfactory if the appearance is white, smooth, relatively glossy, and obviously adherent, and has a thickness of about 70 microns.

It has been found that conventional hot-dip galvanisation of the relatively recent building steels which contain more than 0.01% of silicon gives poor results, the zinc coatings appearing greyish, indicating the formation of fragile intermetallic compounds, and being of abnormal thickness (200 to 300 μm and more), and of poor adherence both as regards the thickness of the coatings and as regards their fragility.

Steels in the state they are produced using modern continuous casting processes can be classified by their silicon content into the following categories:

effervescent steels ($Si<0.01\%$)
semi-calmed steels ($0.01\%<Si<0.10\%$)
calmed steels ($Si\sim0.15\%$)
high silicon content steels ($Si<0.20\%$)

Actually, the conventional classification and terminology for silicon-containing steels is poorly defined, and the content limits of the silicon contents of calmed steels and semi-calmed steels vary according to the source of manufacture.

The thickness and crystalline state of zinc coatings produced by hot dip galvanisation are closely linked with the kinetics of the reaction between iron and zinc, which is modified by the presence of silicon. Moreover, iron-zinc reactivity is not proportional to the silicon content. Effervescent steels are galvanised without difficulty, but semi-calmed steels are highly reactive and the coatings obtained are thick and not very adherent. Calmed steels are substantially more reactive than effervescent steels, but substantially less reactive than semi-calmed steels. Finally, steels containing more than 0.2% of silicon are very highly reactive.

This has the result that steels containing silicon cannot be galvanised by conventional immersion processes. If parts of regular shape and composition are treated, it certainly does not appear impossible to develop galvanisation processes giving suitable coatings on these parts if parameters such as immersion time in the galvanisation bath, temperature of the bath, nature of the flux, rate of cooling, and so on are carefully regulated. Thus, high-strength silicon steel bolts can be galvanised, but in general it is not possible for operating conditions for different parts to be controlled in an economically viable manner. This is particularly true of jobbing galvanisation, where the galvaniser has to coat parts having a composition which is not known to him and which moreover varies with the type of part, the customer, and so on.

It is known that the addition to galvanisation baths of aluminium in amounts ranging from 100 to 5000 ppm by weight reduces the reactivity of the zinc in relation to silicon steels. The coatings obtained are thinner, more adherent, and more satisfactory in appearance. Nevertheless, it is found that the coatings obtained are not free from bare patches. It is assumed that the alumina formed by oxidation of the aluminium combines with the flux and covers the steel in places, thus preventing the zinc-iron reaction from taking place.

SUMMARY OF THE INVENTION

The present invention relates to an aluminium-containing galvanisation alloy which does not have these shortcomings.

An object of the present invention is to provide a galvanisation alloy suitable equally for steels containing less than 0.01% of silicon and for steels in which the silicon content is as high as at least 0.2%.

According to the present invention there is provided an alloy suitable for the galvanisation of steels by an immersion galvanisation process, including galvanisation of steels containing silicon, the alloy comprising zinc of commercial purity and having a lead content of the order of from 1000 to 20000 ppm by weight, an aluminium content of from 100 and 5000 ppm by weight, a magnesium content of from 10 to 1000 ppm by weight and a tin content of from 300 to 20000 ppm by weight.

The invention is based on a finding that the presence of tin in the zinc alloy greatly reduces the number of bare patches in the resultant coating of zinc alloy. Similarly, the presence of magnesium makes it possible to obtain coatings entirely without bare patches. The simultaneous presence of tin and magnesium gives more reliable results and increases the life of the galvanisation bath, the tin making up for any magnesium which might disappear through oxidation.

The preferred contents by weight are from 300 to 600 ppm of aluminium, from 20 to 200 ppm of magnesium, and from 1000 to 3000 ppm of tin.

Excellent results have been obtained with an alloy containing substantially 600 ppm of aluminium, 100 ppm of magnesium, and 2500 ppm of tin, the parts being by weight in all cases.

In another aspect, the invention relates to an immersion galvanisation process utilising the alloys mentioned above, wherein after degreasing, rinsing pickling in concentrated hydrochloric acid containing a corrosion inhibitor, and rinsing, pickling is effected in concentrated hydrochloric acid without inhibitor, followed by rinsing, and after conventional fluxing and drying the parts are immersed in the molten galvanisation bath incorporating the alloy of the invention.

Excellent results have been obtained with a first pickling with 6 N hydrochloric acid containing a corrosion inhibitor, and a second pickling with hydrochloric acid of a concentration of 6 to 12 N without inhibitor.

BRIEF DESCRIPTION OF THE DRAWINGS

The present invention will now be illustrated, by way of example only, with reference to the accompanying drawings, in which.

DETAILED DESCRIPTION OF THE INVENTION

Figure 1:
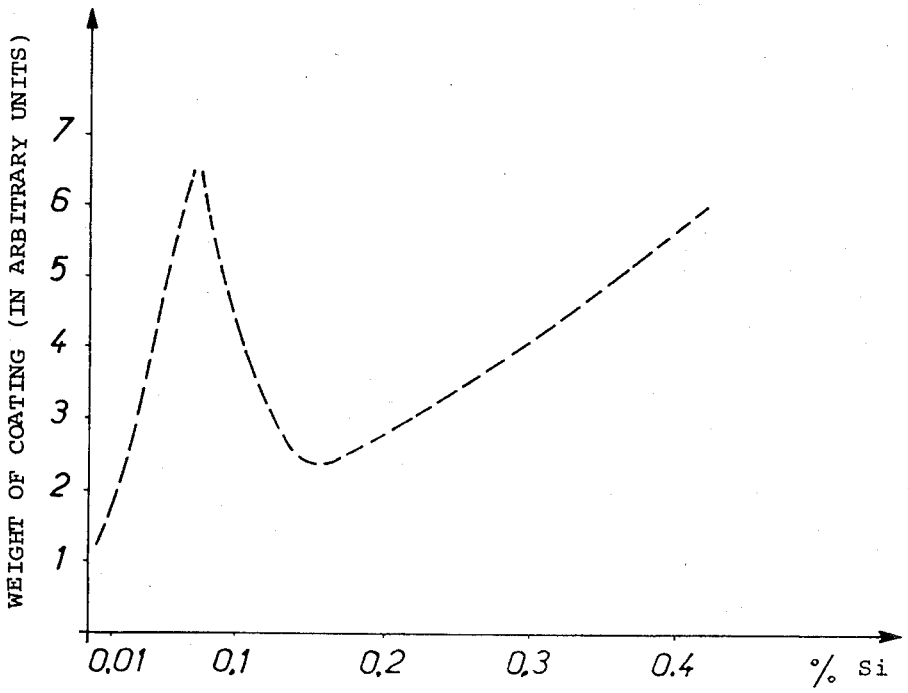
FIG. 1 shows a graph on which the thickness of a coating of zinc (deposited on silicon-containing steels using a conventional hot dip galvanisation bath) is plotted against the silicon content of the steel.

Considering the graph of FIG. 1, which shows on the abscissa the silicon content of the steel and on the ordinate the thickness of a deposit expressed in arbitrary units of mass zinc deposited per unit of surface, it is found that, if the thickness of coating on a steel containing less than 0.01% of silicon is taken as unity, the thickness increases as the silicon content increases, until it reaches a maximum value at about 0.05% silicon, the maximum though not precisely known exceeding 6, and then decreases to a minimum value at about 0.16% silicon, the minimum value being about 2.5, and finally increases regularly. It will be realised that the irregularity of the thickness of the deposits obtained is greater, the greater the slope of the curve. Since excessive thickness of the coating is due to the rapid formation of fragile intermetallic compounds, it will be realised that irregularities of thickness lead to deficiencies in the adherence of the coating.

The curve in FIG. 1 also shows the serious difficulties arising with conventional galvanisation baths in the coating of parts having diferent silicon contents. If in fact it is conceivable to develop a galvanisation process for parts having a known, constant silicon content by adjusting the temperature of the bath to modify the rate of formation of intermetallic compounds, and correspondingly adjusting the immersion time and rate of cooling of the coated part so as to stabilise the thickness of intermetallic compounds, this development would need numerous experiments, which can be justified only for very large homogeneous series.

It is known that the presence of aluminium reduces the reactivity of the iron-zinc pair. It is also known that the presence of aluminium in amounts of from 100 to 5000 ppm in the zinc reduces the reactivity of silicon steels in relation to zinc. Conventional galvanisation baths to which aluminium has been added within the range indicated above give as a rule smooth, white, glossy coatings without excessive thicknesses. Unfortunately, the coatings obtained in such baths have bare spots. These bare spots are attributed to the formation of alumina through the oxidation of aluminium, this alumina being entrained by the flux which covers the part to be galvanised and forming an adherent skin on the steel, which the molten zinc will not wet.

In the course of studies of the galvanisation of silicon steels which led to the present invention it was determined that the addition of two metals to galvanisation baths containing the above-mentioned amounts of aluminium made it possible to reduce or eliminate bare patches due to the presence of aluminium.

By adding tin to the bath a spectacular reduction of the number of bare spots is achieved. The effect, which is noticeable starting from 50 ppm of tin in the bath, becomes significant above 300 ppm. Above 20,000 ppm of tin in the bath the coatings contain tin in excessive proportions. The most interesting results are obtained with tin contents of from 1000 to 3000 ppm. Although the exact mechanism of the reaction of tin in the galvanisation has not been elucidated, it seems probable that the tin increases the fluidity of the molten zinc and also the ability of steels to be wetted by zinc, thereby facilitating the elimination of flux contaminated with alumina. Zinc baths containing aluminium and tin in the contents previously mentioned permit the galvanisation of silicon steel parts with less than 10% of defective parts.

By adding magnesium to a zinc bath containing aluminium, bare spots are practically completely eliminated. Magnesium starts to be effective in amounts of the order of 10 ppm. Since magnesium is more readily oxidisable than aluminium, it is very probable that it reduces the formation of alumina, while magnesia reacts with the flux to form magnesium chloride, a compound which does not substantially modify the fluidity of the flux at the temperature of the galvanisation bath, provided that it is present in small amounts. Thus, a magnesium content of 1000 ppm in the bath should not be exceeded, because if it is the formation of magnesia by oxidation of magnesium is excessive. The best results have been obtained with magnesium contents of from 20 to 200 ppm, for which the disappearance of the magnesium by oxidisation is not excessively rapid and without the bath containing a troublesome excess of magnesia.

Tests have also shown that in galvanisation baths tin and magnesium practically do not react with one another, at least at the contents indicated above, so that the stabilising actions of these two metals do not counteract one another. By adding magnesium and tin to galvanisation baths containing aluminium within the limits of the contents mentioned above, durable and stable galvanisation baths are obtained. If in fact the magnesium content falls below the effective content as the result of oxidation, tin acts as a stabiliser and the bath remains utilisable.

Tests have shown that the alloys for galvanisation baths which gave the best results in respect of effectiveness and long life contained from 300 to 600 ppm of aluminium, from 20 to 200 ppm of magnesium, and from 1000 to 3000 ppm of tin in addition to zinc of Z6 or Z7 quality (standard AFNOR NFA 55101, April, 1955) and lead in the usual contents of 1000 to 15000 ppm. A standard alloy contains substantially 600 ppm of aluminium, 100 ppm of magnesium, and 2500 ppm of tin. These alloys in particular have been found capable of very wide use, giving equivalent results under similar operating conditions with effervescent steels containing less than 0.01% of silicon, with semi-calmed steels containing from 0.02 to 0.10% of silicon, calmed steels containing 0.15% of silicon, and steels containing more than 0.2% of silicon.

Figure 2:
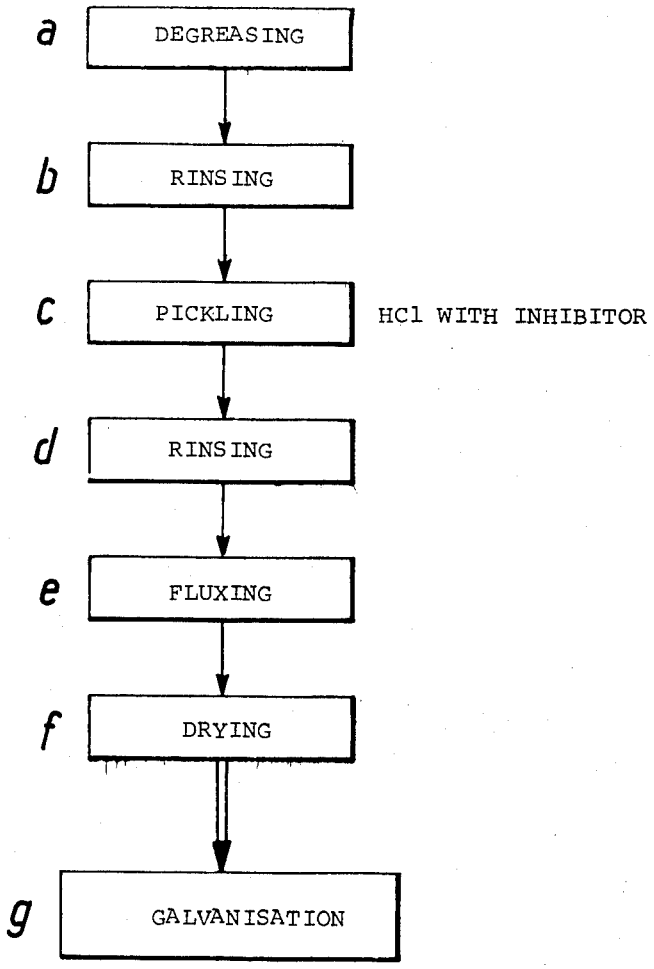
(PRIOR ART) FIG. 2
FIG. 2 is a diagram of the stages of conventional hot dip galvanisation.
Figure 3:
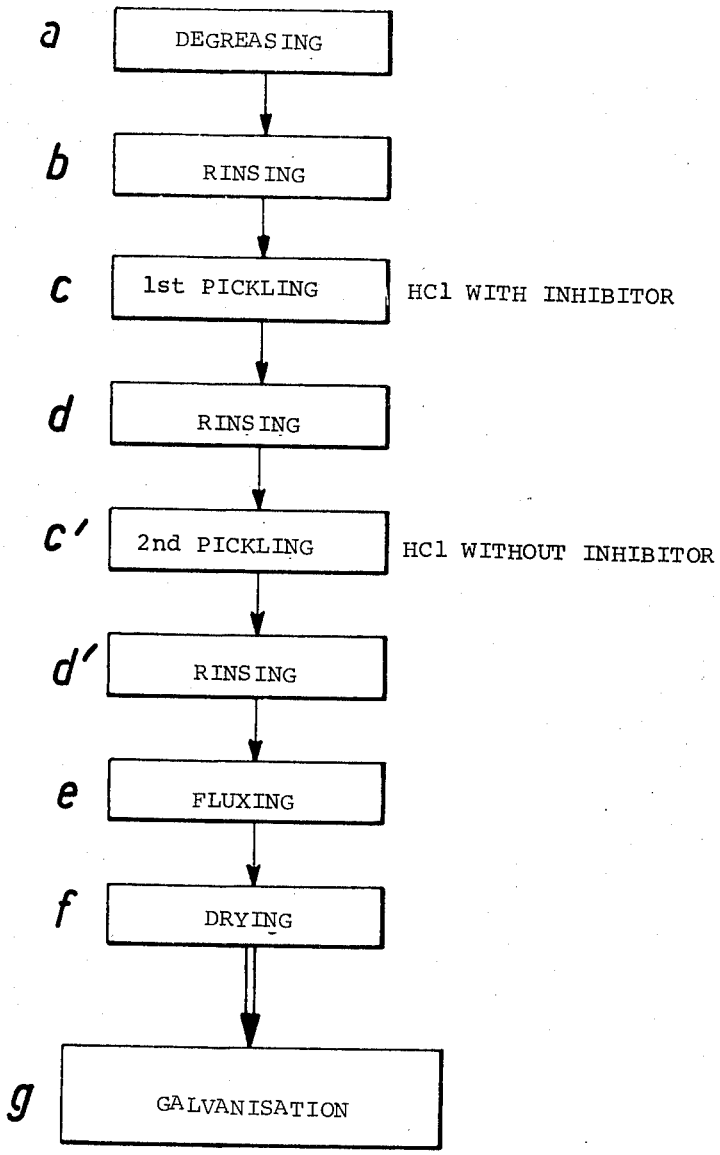
FIG. 3 is a diagram of the galvanisation stages in a preferred embodiment of the present invention.

FIG. 2 shows a conventional surface preparation process which comprises degreasing, rinsing, pickling with concentrated hydrochloric acid to which a corrosion inhibitor has been added, rinsing, fluxing, and drying. In order to facilitate the use of the alloys according to the invention in an immersion galvanisation process it is advantageous to make the operating conditions for the actual galvanisation more flexible and to supplement the steps shown in FIG. 2. The surface preparation process with the additional steps is illustrated in the diagram of FIG. 3. Between the rinsing following pickling in hydrochloric acid containing an inhibitor there is interposed pickling in concentrated hydrochloric acid without inhibitor, followed by rinsing. This pickling has the object of completing the cleaning of the steel by dissolving from 2 to 3 microns of steel from the surface of the part.

The concentration of the hydrochloric acid in the first pickling is advantageously 6 N, whereas the concentration of the acid in the second pickling is preferably from 6 to 12 N.

The invention is also illustrated by the following comparative examples.

EXAMPLE 1.

Immersion galvanisation of a steel containing 0.06% of silicon.

A control is galvanised in a conventional bath of Z6-Z7 zinc after conventional surface preparation (in accordance with the diagram in FIG. 2). A similar specimen is galvanised in a bath containing 600 ppm of aluminium, 100 ppm of magnesium, and 2500 ppm of tin in addition to the Z6-Z7 zinc, after surface preparation in accordance with the diagram in FIG. 3 (first pickling in 6 N HCl with inhibitor for 45 minutes, second pickling in 12 N HCl without inhibitor for 5 minutes). The characteristics of the coatings are given in Table I.

TABLE I

| Characteristics | | Specimen | Control |
|---|---|---|---|
| Appearance: | colour | white | grey-black |
| | gloss | glossy/matt | marbled matt |
| | roughness | smooth | rough |
| Adherence | | good | poor (fragile) |
| Thickness | | 70–90μm (normal) | 200–300μm (very thick) |

EXAMPLE 2

Immersion galvanisation of a steel containing 0.1% of Si.

A control is galvanised in a conventional bath of Z6, Z7 zinc; a similar specimen is galvanised in the same bath as the specimen of Example 1. Surface preparations are identical, in accordance with the conventional diagram of FIG. 2. The characteristics of the coatings are shown in Table II.

TABLE II

| Characteristics | | Specimen | Control |
|---|---|---|---|
| Appearance: | colour | white | grey |
| | gloss | glossy/matt | matt, marbled |
| | roughness | smooth | rough |
| Adherence | | good | poor |
| Thickness | | 70–90μm (normal) | 150–250μm (very thick) |

The fact that it is possible for steels having silicon contents within a range extending from less than 0.01% to more than 0.2% to be subjected to immersion galvanisation practically by the same operational processes, utilising the galvanisation alloys and the processes of the invention, is found extremely advantageous, particularly for jobbing galvanisation. It then becomes possible for batches of parts whose composition is not known to the operator to be galvanised simultaneously and in the same bath, and the range of operation does not need to be modified when different parts have to be galvanised.

It does without saying that the compositions of galvanisation baths given in the foregoing examples and referred to in general throughout the description and claims contain in addition to the constituants given in their parts per million a quantity of commercially pure zinc which makes up the balance of the bath in each case.

I claim:

1. An immersion galvanisation process for galvanising silicon steel containing more than 0.01% by weight silicon, comprising the steps of:
   (a) degreasing the steel to be galvanised and then rinsing the steel;
   (b) pickling the steel with concentrated hydrochloric acid containing a corrosion inhibitor and then rinsing the steel;
   (c) pickling the steel in concentrated hydrochloric acid containing no inhibitor, followed by rinsing the steel;
   (d) fluxing the steel and then drying it; and
   (e) immersing the steel in a molten bath of an alloy consisting essentially of zinc of commercial purity and having a lead content of the order of 1000 to 20000 p.p.m. by weight, an aluminum content of from 100 to 5000 p.p.m. by weight, a magnesium content of from 10 to 1000 p.p.m. by weight and a tin content of from 300 to 20000 p.p.m. by weight.

2. A process as claimed in claim 1, wherein the concentration of hydrochloric acid in step (b) is about 6 N and that in step (c) is from 6 to 12 N.

3. An immersion galvanisation process for galvanising silicon steels, comprising immersing a steel containing more than 0.01% by weight silicon in a molten bath of an alloy consisting essentially of zinc of commercial purity and having a lead content of the order of 1000 to 20000 p.p.m. by weight, an aluminum content of from 100 to 5000 p.p.m. by weight, a magnesium content of from 10 to 1000 p.p.m. by weight and a tin content of from 300 to 20000 p.p.m. by weight.

* * * * *